US005269505A

United States Patent [19]

Sardano

[11] Patent Number: 5,269,505

[45] Date of Patent: Dec. 14, 1993

[54] FRICTION RETARD FEEDER WITH A STEPPED RETARD PAD

[75] Inventor: Peter A. Sardano, Fairport, N.Y.

[73] Assignee: Xerox Corporation, Stamford, Conn.

[21] Appl. No.: 804,611

[22] Filed: Jul. 29, 1991

Related U.S. Application Data

[63] Continuation of Ser. No. 456,435, Dec. 26, 1989, abandoned.

[51] Int. Cl.[5] ..... B65H 3/52

[52] U.S. Cl. ..... 271/121; 271/167

[58] Field of Search ..... 271/121, 124, 137, 35, 271/167, 138

[56] References Cited

U.S. PATENT DOCUMENTS

| | | | |
|---|---|---|---|
| 3,539,179 | 11/1970 | Bergman | 271/39 |
| 3,838,851 | 10/1974 | Kolibas | 271/124 |
| 3,874,652 | 4/1975 | Bilbrey | 271/6 |
| 3,941,373 | 3/1976 | Stange | 371/124 |
| 4,216,952 | 8/1980 | McInerny | 271/10 |
| 4,346,879 | 8/1982 | Ruenzi | 271/121 |
| 4,500,842 | 2/1985 | McInerny | 271/35 |
| 4,555,103 | 11/1985 | Larson | 271/35 |
| 4,579,332 | 4/1986 | Larson | 271/121 X |
| 4,653,743 | 3/1987 | Ebata et al. | 271/167 X |
| 4,667,244 | 5/1987 | Ishikawa | 358/294 |
| 4,708,462 | 11/1987 | Stemmle | 355/24 |
| 4,887,806 | 12/1989 | Tanaka et al. | 271/121 |

FOREIGN PATENT DOCUMENTS

| | | | |
|---|---|---|---|
| 2588537 | 4/1987 | France | 271/121 |
| 2588538 | 4/1987 | France | 271/121 |
| 57-13039 | 1/1982 | Japan | 271/121 |
| 17037 | 2/1983 | Japan | 271/121 |
| 60-244734 | 12/1985 | Japan | 271/121 |
| 238629 | 10/1986 | Japan | 271/121 |
| 295841 | 12/1987 | Japan | 271/121 |
| 51235 | 3/1988 | Japan | 271/121 |
| 1529694 | 10/1978 | United Kingdom . | |

*Primary Examiner*—Cheryl L. Gastineau

[57] ABSTRACT

A document handling apparatus includes a friction retard feeder for feeding documents from a stack. The friction retard feeder has a feed belt and a retard pad with a concaved portion as well as an inclined, but essentially straight stepped portion that shingles the documents in order to inhibit multifeeding, stubbing and reduce image abrasion of documents during feeding.

3 Claims, 3 Drawing Sheets

FRICTION RETARD FEEDER WITH A STEPPED RETARD PAD

This is a continuation of application Ser. No. 07/456,435, filed Dec. 26, 1989 abandoned.

Copending and commonly assigned U.S. application Ser. No. 07/429,231 filed 10/31/89 entitled FRICTION RETARD FEEDER WITH A CONCAVE RETARD PAD which is a Continuation-in-Part of U.S. Pat. application Ser. No. 07/289,116 filed Dec. 12, 1988 entitled FRICTION RETARD FEEDER WITH A CONCAVE RETARD PAD, now abandoned, both applications by Gerald M Garavuso are hereby cross-referenced and incorporated herein by reference.

This invention relates to a paper feeder for an apparatus for recording images, data and the like on paper, hereinafter referred to as a recording apparatus, and more particularly to a friction retard feeder having a stepped or stepped and concaved retard pad for such an apparatus.

To date, most friction retard feeders use a friction belt to feed sheets of paper and a retard roll or belt to inhibit multiple sheet feeds. In either application, the friction belt is made to wrap around the retard roll or belt through some nip wrap angle. The retard surface has almost always been convex and supported from behind by a solid effectively incompressible member such as the roller in, e.g., United Kingdom Patent Specification 1,529,694. In separation of a three page slug, for example, the retard material at the lead edge of the slug may be compressed since this is the focal point of a local peak in nip pressure. Compliance of the retard material will determine how much of the wrap angle is needed in front of a sheet stack before the belt returns to an uncompressed state. Assume that the slug breaks above the third and below the second sheet, the third sheet will stop while sheets one and two continue to move. As the two top sheets cantilever over the stalled sheet, they are bent around the distributed load of the feed belt. It is essential that no further separation is possible until the slug (sheets one and two) again make contact with the retard material. This requires bending of the slug to a curvature greater than the nip curvature and/or high compliance of the retard material which will allow the retard surface to rise to the slug. Most friction retard feeders make use of both of these mechanisms by placing strict specifications on feed belt tension and retard compliance by still requiring long nips to effect separation of large slugs.

An improvement over these types of friction retard feeders is shown in U.S. Pat. Nos. 4,216,952 and 4,500,084 each of which includes a feed roll and a concave retard belt that allows belt tension and retard material compliance to be reduced to smaller significance levels. However, a problem with this type of friction retard feeder is that stubbing occurs in the nip between the retard roll and the retard belt. This is especially significant when curled sheets are fed. An improvement over these friction retard feeders is the use of a concave retard pad with a feed roll as disclosed in heretofore mentioned copending application Ser. No. 07/429,231.

Other relevant prior art includes U.S. Pat. Nos. 3,539,179; 4,346,879; 4,555,103, and 4,667,244 as well as Japanese Publications 57-13039 and 60-244734. In U.S. Pat. No. 3,539,179, a paper currency counting machine is disclosed that has a feed runaway that mates with a feed roll in order to feed single bills from a stack. U.S. Pat. No. 4,346,879 is directed to a mechanism for feeding documents to a copying apparatus which has separating plates that cooperate with separating rolls to feed single documents. A bottom sheet feeder is shown in U.S. Pat. No. 4,555,103 that employs an endless feed belt and a retard pad to separate single sheets from a stack. The feeder includes an inclined lead surface plate that sheets in the stack are driven against. A paper feeding device that includes a friction retard member with a concaved portion and a paper separating roll is disclosed in U.S. Pat. No. 4,667,244. Japanese reference 57-13039 is directed to an automatic paper feeder that enables a friction member to come in uniform contact with a paper feeding roller by utilizing resilient force of a resilient plate itself. The Ricoh reference 60-244734 is directed to preventing the overlapped feeding of sheets by use of a separating roll and an adjustable rubber plate. The rubber plate touches the separating roll and an adjustable plate pushes against the rubber plate upstream of the separation section between the rubber plate and separating roll.

Accordingly, a solution to the problem of stubbing that occurs in the nip between a retard roll and belt is disclosed that includes the use of a stepped or stepped concave retard pad in cooperation with a feed belt in order to inhibit multifeeding and stubbing of curled sheets.

The above-mentioned features and others of the invention, together with the manner of obtaining them, will best be understood by making reference to the following specification in conjunction with the accompanying drawings, wherein.

Figure 1:
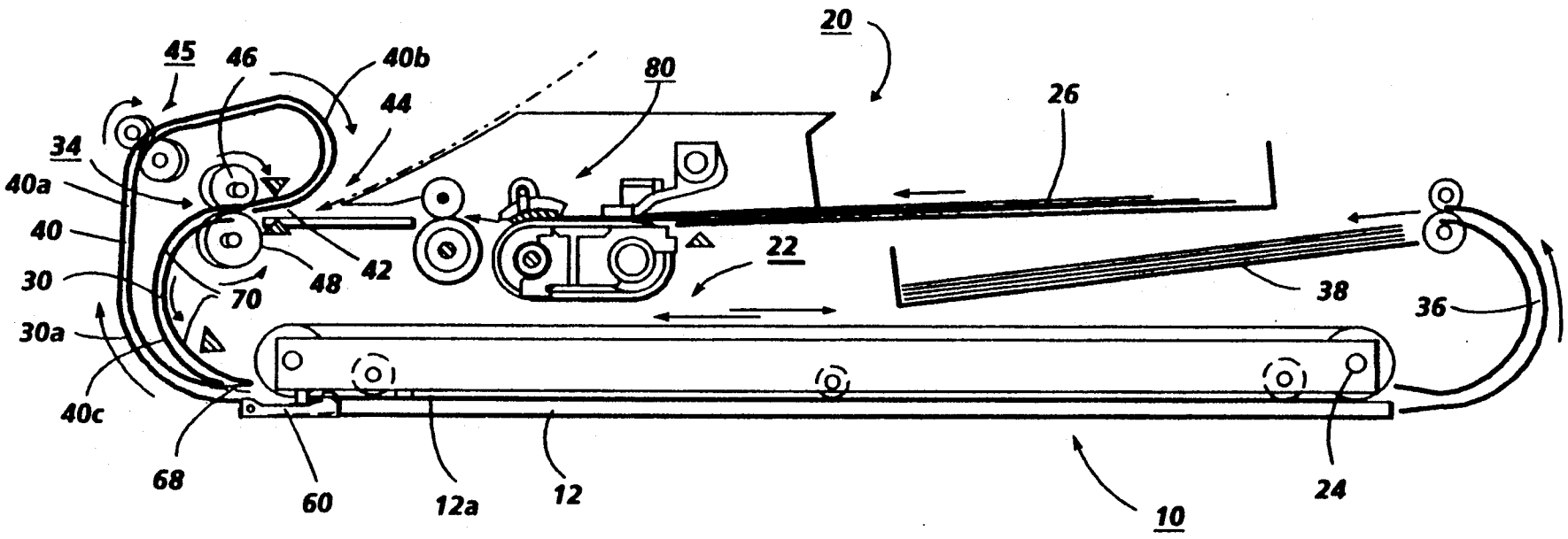
FIG. 1 is a schematic elevational view showing an electrophotographic recording apparatus employing the friction retard feeder with the stepped concave retard pad of the present invention.
Figure 2:
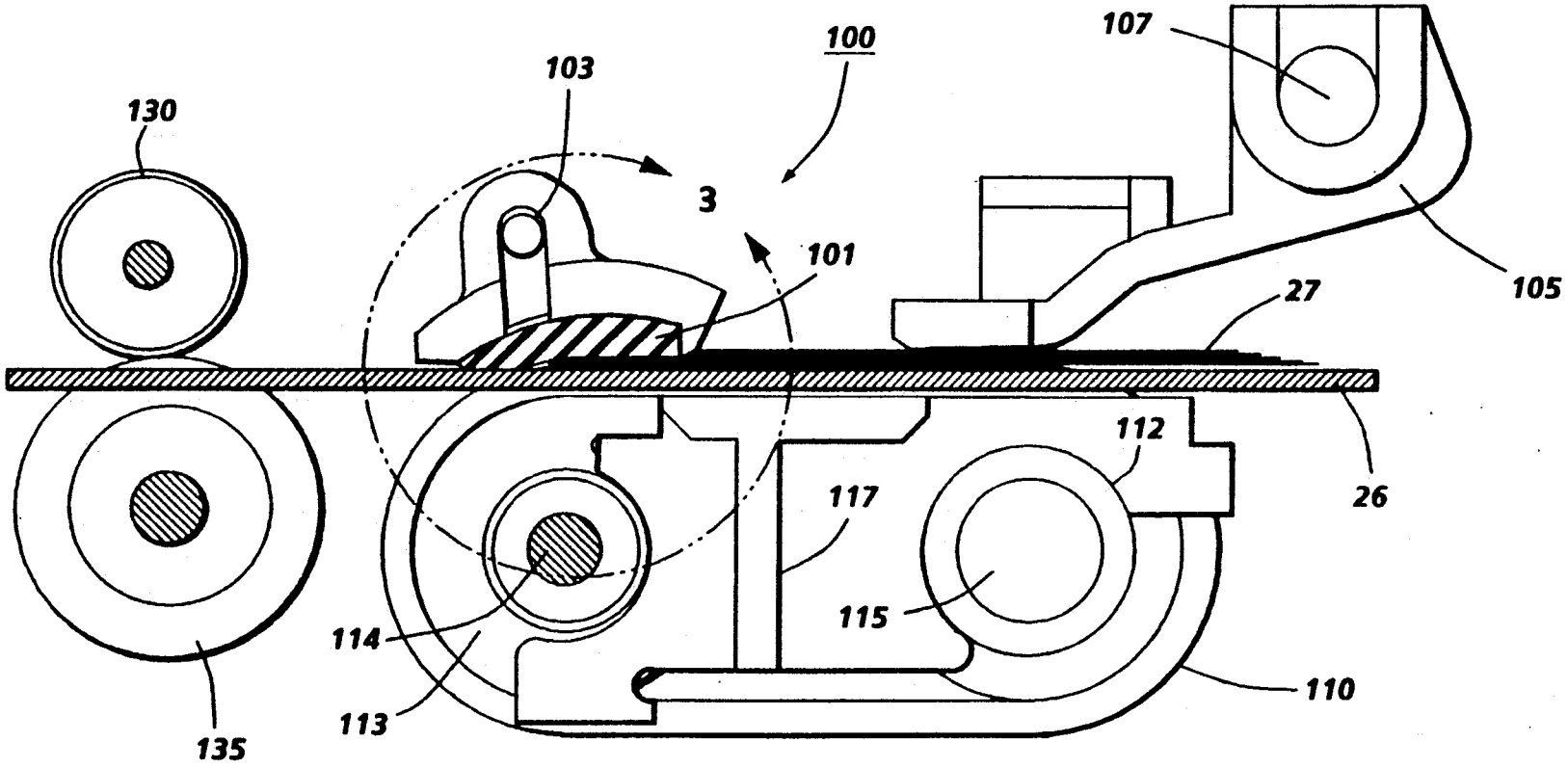
FIG. 2 is a partial elevational view of the friction retard feeder with the stepped concave retard pad of the present invention as shown in FIG. 1.
Figure 3:
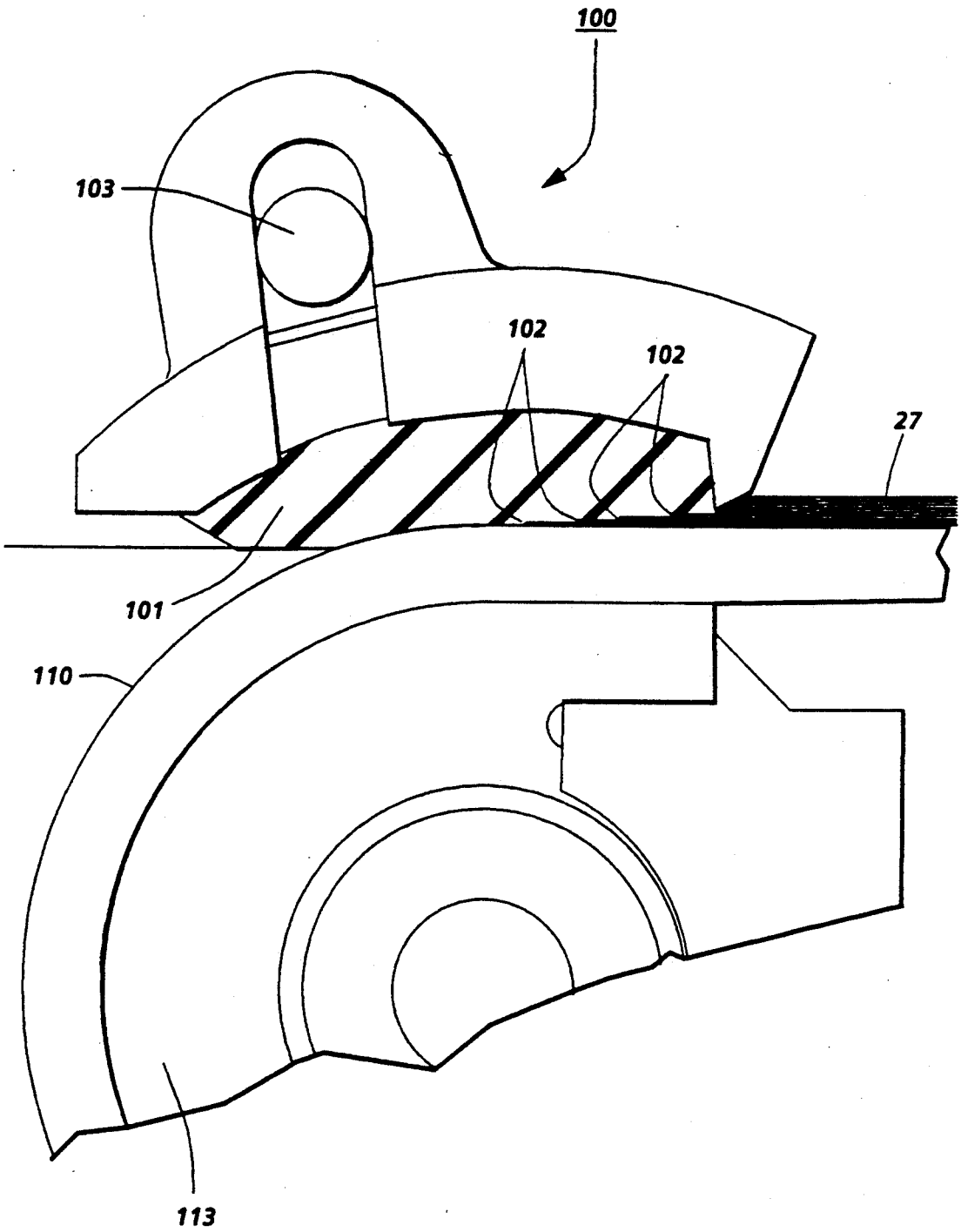
FIG. 3 is an enlarged partial elevational view of a portion of the friction retard feeder of FIG. 2 showing the stepped portion of the retard pad.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings. In the drawings, like reference numerals have been used throughout to designate identical elements By way of background description of a suitable copier with which this duplex document handling system (DDHS) may be used, there is noted Xerox Corporation U.S. Pat. No. 4,708,462 on Dual Mode Duplexing issued to Denis J. Stemmle. It discloses a copier which can select between immediate (direct loop path) duplexing or conventional duplex buffer tray (stack) duplexing, for optimizing duplex copying under various conditions (set size, sheet size, etc.). It should also be apparent that the present invention can be used with any sheet feeding system.

Referring to the DDHS example of FIG. 1, it will be appreciated that the system described herein may be utilized with various other document handlers, and with almost any copier, including various of those incorporated by reference herein. Thus the only portion of an exemplary copier 10 which need be illustrated here is the copier platen 12.

In the exemplary DDHS system 20 disclosed here all modes of operation utilize the same trays and feeders, including platen document transport 22 and its drive (preferably comprising a stepper or servo motor 24 with encoder). Components may also be shared with a recirculating document handling (RDH) mode of operation of this document handler. All documents to be copied by the copier 10 are sequentially fed to the platen 12 by the DDHS 20 where they are driven over platen surface 12*a* into a desired copying registration position by the platen transport 22 with its drive 24, and then ejected by that belt transport system 22 from the platen 12. For all modes, including recirculating (precollation) document copying, the set of original documents may be initially loaded stacked face-up into the document tray 26. They are sequentially fed out from the bottom of the stack by the sheet separator/feeder 80 of the present invention in all modes.

Referring particularly to FIG. 1, all document sheets 27 are initially fed downstream from the tray 26 through a simplex path 30 to the acquisition entrance to the belt transport system 22, adjacent the platen 12. The tray 26 overlies the platen, and the path 30 conventionally provides the shortest possible path connection. The simplex path 30 has a single "C" shaped inversion inverting segment 30*a*. Thus the documents are turned over once before being presented to the platen. As will be described later herein, the initial portion of this simplex path 30, (just downstream of the separator/feeder 100, segment 30*a*) includes side registration and deskewing system 34 which may be a known crossed-rolls edge guide system. The feeder 100 of the present invention comprises an adjustably mounted retard pad 101 that has a stepped concave retard portion 102 adjacent a horizontal and convex portion of feed belt 110 which separates document sheets 27 from stack 26. Feed belt 110 is supported on shafts 114 and 115 and entrained around drive roller 114 and idler roller 115. A double-T shaped member 117 supports feed belt 110 between rollers 114 and 115. A shingling feature in the form of a stepped profile with steps 102 on the sheet contacting surface of retard pad 101 aids in slug fanning a slug of sheets and allows only a minimum number of sheets in the slug to enter the retard zone. The retard pad 101 possesses a stepped profile with risers of the steps of about 0.2 mm which allows a slug to enter the retard zone. The retard pad could have a multiple steps, if desired. The step(s) are machined into the retard pad profile. Also, the retard pad may be concave or a flat incline depending upon the media being fed. As the slug continues to the drive nip area, it is continually reduced until only one or two sheets are present in the actual nip. The retard pad works with friction feed belt 110 to insure that only one sheet passes through the nip and is propelled by the feed belt to take away rolls 130 and 135. Alternative retard pads of the present invention include a single stepped pad with inclined surfaces leading to and away from the step; a retard pad with dual steps and inclined surfaces; and a single stepped, concave pad with one inclined surface. The stepped retard profile has proven to reduce side one and side two smudge created from image abrasion by minimizing excessive sheet to sheet start-stop.

Feeder 100 includes a nudger ski 105 pivotally mounted on shaft 107 that provides a normal force to sheets 27. The nudger ski is positioned on top of the sheet stack and adjacent retard pad 101. Stepped portion 102 of retard pad 101 performs the shingling function on sheets 27 and eliminates the need for separate pre-shingling of sheets before they reach the retard pad as is normally done.

While there has been illustrated and described what is at present considered to be a preferred embodiment of the invention, it will be appreciated that numerous changes and modifications are likely to occur to those skilled in the art, and it is intended in the appended claims to cover all those changes and modifications which fall within the true spirit and scope of the invention.

I claim:

1. In a friction retard feeding apparatus, including friction means for initially feeding a slug of multiple sheets of paper or the like from a stack and for separating sheets from the stack, and retard means for forming a nip with said friction means for inhibiting multifeeding of sheets, the improvement characterized in that said retard means has a concave retard surface entrance to said nip with a portion of said concave retard surface having a fixed stepped profile, and wherein said stepped profile includes small multiple steps having riser portions of about 0.2 mm orthogonal to a horizontal plane in order to obtain maximum inhibiting of multifeeding of sheets from the stack, each of said riser portions being adapted to inhibit the movement of a limited plurality of sheets thereagainst which is a small portion of a slug of sheets as the slug of sheets is separated from the stack by said friction means, said riser portions being adapted to sequentially reduce the number of sheets in the slug of sheets separated from the stack by said friction means until only a desired number of sheets enter said nip.

2. In a document handler adapted to feed documents from a stack and including a means for separating a slug of sheets from the stack and retard means for sequentially separating and reducing the number of documents in the slug of documents until only one document is fed away from the retard means, the improvement of the retard means, characterized in that the retard means includes a concave portion adjacent the means for separating a slug of documents from the stack of documents, said concave portion of said retard means having a series of steps with each step having a riser portion that is orthogonal with respect to a horizontal plane, said riser portion being adapted to accommodate a plurality of documents such that the number of documents in the slug of documents is sequentially reduced as the documents are fed until only one document is forwarded beyond the document handler.

3. The document handler of claim 2, wherein said series of steps which each accommodate a plurality of documents each include riser portions of about 0.2 mm, said riser portions being adapted to sequentially shingle the slug of documents into multiple document groups of decreasing size in order for individual documents to be fed away from the document handler.

* * * * *